United States Patent [19]

Shaw

[11] Patent Number: 4,985,942

[45] Date of Patent: Jan. 22, 1991

[54] HANDRAIL SLEEVE

[76] Inventor: Tony G. Shaw, 6620 Bubbling Brook Dr., #B, Las Vegas, Nev. 89107

[21] Appl. No.: 367,456

[22] Filed: Jun. 16, 1989

[51] Int. Cl.[5] ..... E04H 03/16; E06C 01/36

[52] U.S. Cl. ..... 4/496; 138/110; 138/128; 138/156; 138/167; 138/178; 428/99; 428/100; 4/504; 4/576

[58] Field of Search ..... 138/99, 103, 110, 177, 138/178, 156, 167, 168, 149, 128; 4/576, 496, 504; 182/46, 47, 106, 230; 16/116 R; 174/DIG. 11; 428/99, 100

[56] References Cited

U.S. PATENT DOCUMENTS

| | | | |
|---|---|---|---|
| 5,731 | 1/1874 | Boyd | 138/128 |
| 681,470 | 8/1901 | Wolff | 138/128 |
| 2,424,315 | 7/1947 | Hyatt et al. | 138/128 |
| 2,466,719 | 4/1989 | MacKearnin | 38/95 |
| 2,585,054 | 2/1952 | Stachura | 138/128 |
| 2,644,954 | 7/1953 | Jumper | 4/185 |
| 2,756,172 | 7/1956 | Kidd | 154/44 |
| 2,817,095 | 12/1957 | Jeffries | 4/185 |
| 2,992,697 | 7/1961 | Klages | 182/206 |
| 3,065,820 | 11/1962 | Prizler et al. | 4/496 |
| 3,233,699 | 2/1966 | Plummer | 181/62 |
| 3,464,094 | 9/1969 | Mates | 24/204 |
| 3,654,049 | 4/1972 | Ausnit | 161/7 |
| 3,792,750 | 2/1974 | Madison | 182/206 |
| 3,941,159 | 3/1976 | Toll | 138/147 |
| 4,009,735 | 3/1977 | Pinsky | 138/147 |
| 4,089,459 | 5/1928 | Huard | 138/128 |
| 4,142,565 | 3/1979 | Plunkett | 138/149 |
| 4,323,610 | 4/1982 | Leverich | 428/100 |
| 4,400,420 | 8/1983 | Bakken et al. | 428/99 |
| 4,418,792 | 12/1983 | Cerone | 182/93 |
| 4,512,042 | 4/1985 | Striegel et al. | 4/496 |
| 4,899,414 | 2/1990 | Irwin | 428/100 |

FOREIGN PATENT DOCUMENTS

| | | | |
|---|---|---|---|
| 1100401 | 2/1961 | Fed. Rep. of Germany | 138/128 |
| 738642 | 12/1932 | France | 138/128 |
| 358094 | 4/1931 | United Kingdom | 138/128 |

*Primary Examiner*—James E. Bryant, III

*Attorney, Agent, or Firm*—Quirk, Tratos & Roethel

[57] ABSTRACT

A removable sleeve for covering a metal tubular handrail for a swimming pool or spa comprises an elongated substantially rectangular sheet of synthetic elastomer having a sheet of fabric bonded to the exterior surface thereof, and releasable securing structure extending along substantially the entire length of the opposite edges of the elongated sheet for joining the opposite edges to secure the sleeve around and along the tubular handrail.

7 Claims, 2 Drawing Sheets

HANDRAIL SLEEVE

BACKGROUND OF THE INVENTION

This invention relates to a handrail used in connection with a swimming pool or spa, and more particularly to a handrail sleeve that is disposed around and along the handrail.

Swimming pool or spa handrails are generally made of a tubular metal, often chrome-plated or otherwise of a high shine or glass metallic surface normally of one piece tubular lengths, having both ends secured in the deck surrounding the pool. Alternatively, a second end of the single length of handrail is secured near the bottom or along the side of the pool, or welded or otherwise secured along the length of the handrail. Either of such handrail designs comprise a single length of tubing above the pool deck surface and have a straight tubular portion and contiguous curved or arc-shaped portion which extends near the edge of the pool, sometimes slightly over the edge so that it can be conveniently reached and grasped by the hands of a swimmer in the pool. Because of the highly polished tubular metal construction, such handrails are often slippery and difficult to grasp with a wet hand. Moreover, in warm weather, particularly in the Southwest where afternoon summer temperatures may be well above 100° F., such a handrail becomes very hot and can burn a user's hand, especially where the handrail has been exposed to the sun for any period of time. It is to the elimination of such problems that the present invention is directed.

SUMMARY OF THE INVENTION

The present invention comprises a removable sleeve for being secured around the exterior surface of a tubular metal handrail. The sleeve is a laminated construction having an inner elastomeric layer adjacent to the metal handrail and an outer fabric layer exposed to the grasp of the user. The sleeve may be easily secured around either or both of the straight and contiguous curved portions of the handrail to substantially cover the handrail along the entire length which would be normally grasped or held by a user when entering or leaving a pool or spa. These as well as other advantages and the components and features of the invention will be explained hereinafter.

DETAILED DESCRIPTION OF THE INVENTION

Figure 1:
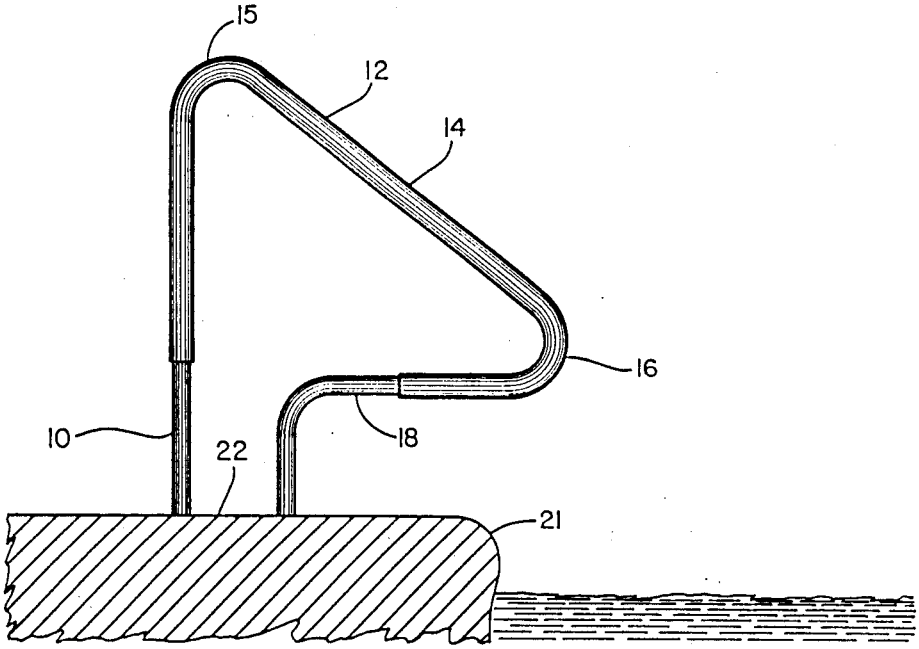
FIG. 1 is a side view showing the sleeve of the invention installed on a swimming pool or spa handrail.

In FIG. 1 there is shown a commonly used handrail 10 which is normally made of a highly polished metallic tubular material. Such a handrail comprises a single length of tube having both ends secured in a deck 22 so that there are no exposed or accessible handrail ends. The handrail is also secured close to the edge 21 of the pool decking material, often overhanging the edge above the water so that it may by readily and conveniently grasped by a user from within the pool. For this purpose, an arc-shaped or curved portion 16 is nearest the deck edge 21 for being grasped by a swimmer, with a contiguous straight portion 14 angled upwardly therefrom. A second arc-shaped or curved portion 15 is located at the highest point from the deck 22. Each of these curved portions 15 and 16 as well as straight portion 14 are repeatedly grasped by a swimmer or spa user when entering or leaving the pool.

As shown in FIG. 1, removable sleeve 12 may be readily placed over substantially the entire usable length of handrail 10, covering both the curved and the straight handrail portions.

The structure of different embodiments of the sleeve device of the present invention is shown in FIGS. 2–6. The sleeve 12 comprises a laminated construction of an inner layer and an outer layer. The inner layer comprises a substantially or generally rectangular sheet 32 of synthetic elasteromer which will form the inner layer of the sleeve when it is in use. The synthetic elastomer is preferably a thermosetting high polymer, commonly known as synthetic rubber. Typical materials include SBR (styrene-butadiene copolymer), polychloroprene (neoprene), nitrile rubber, butylrubber, polyisoprene, ethylene-propylene terpolymers, silicone rubbers and polyurethane rubbers. Neoprene is especially preferred and is of the type that is normally used for a wet suit. The elasteromeric sheet is backed by an outer layer which is a fabric-like sheet 24 material bonded entirely on one side of the elastomeric sheet. This outer fabric sheet forms the outer surface of the sleeve when it is in use.

The use of such a relatively dense and non-absorbing or close called rubber sheet material is most important since it must be water resistant and not become deteriorated by being wet or exposed to water for even long periods of time, nor absorb water whereby it would become soggy, spongy or water laden. The presence of the fabric backing on the rubber sheet is important since it is this material that is exposed outwardly in the tubular sleeve of the invention allowing a user to grip the fabric backing since it is not slippery, and at the same time this material prevents tearing or other deterioration of the rubber surface itself. Normally, an elastomer thickness of between about 1/16 and ⅛' is suitable for the sleeve material of the invention.

Figure 2:
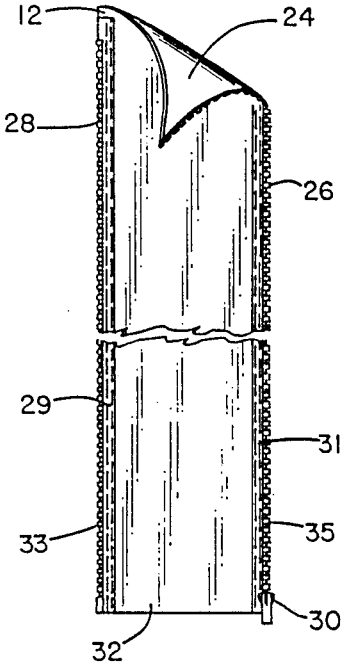
FIG. 2 is a front view of a first embodiment of the invention.

In FIG. 2 there is illustrated a first embodiment of the invention comprising a sheet 32 of elastomer secured entirely along its opposite edges 33 and 35 extending along the length of the sheet 32. In this embodiment, a zipper is used, the zipper being secured substantially along the length of both of the opposite rectangular sheet edges 33 and 35 on the inside or elastomer side of the sheet 32. As shown, opposite zipper components 29 and 31 comprising teeth 28 and 26, respectively, extend along the major length of the piece, which teeth are joined using zipper slide 30. Fabric surface 24 is exposed outwardly when the sleeve is formed around the tubular handrail 10 as shown in FIG. 1. When it is to be used, the elongated sheet 12 is placed over handrail 10 along the portion of the handrail surface to be covered, and the zipper is started and continued until substantially the entire sleeve is closed to fully cover the handrail along the desired length. Because of the nature of the elastomer, there is no kinking or bulging on the outer exposed surface to be grasped by the user. Moreover, it is preferred that the zipper or other closure means be secured on the inside or underside of the handrail so that a smooth outer surface is exposed to the palm of the user's hand when the covered handrail is grasped.

Figure 3:
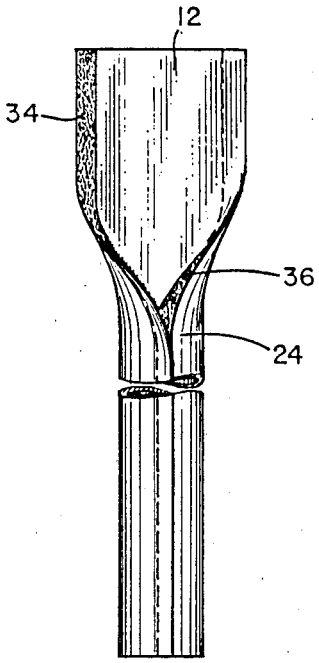
FIG. 3 is a front view of a second embodiment thereof, shown partially open and partially in the sleeve form.

In FIG. 3 there is illustrated yet another embodiment showing different securing means for fastening opposite long edges of the sheet 12. The securing means comprises cooperating hook means and loop means, commercially available as the well-known Velcro ® product. Accordingly, the hook means comprises hook tape 34 having small plastic hook projections extending and exposed therefrom and is stitched or bonded along one long edge of rectangular sheet 12. The loop means comprises loop tape 36 having plastic pile or loops disposed thereon and is secured along the opposite lengthwise sheet edge. The hook tape is secured along the interior elastomer side of the sheet 12 while the loop tape 36 is secured on the outer fabric exposed surface 24 as shown. However, this particular orientation is not necessarily critical to the invention and it may be desirable to reverse the locations of the hook tape and the loop tape so that the loop tape is on the elastomer side of the sleeve while the hook tape is on the fabric side of the sleeve.

Figure 4:
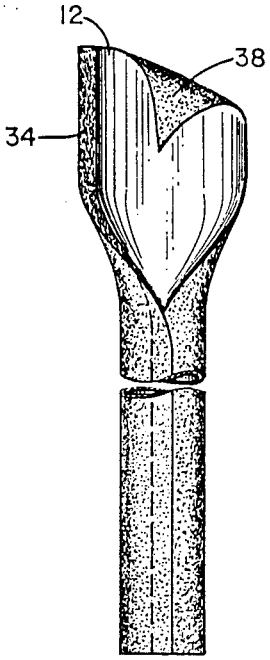
FIG. 4 is a front view similar to FIG. 3 showing a third sleeve embodiment.

Another embodiment is illustrated in FIG. 4 in which the entire outer exposed surface 38 is composed of a fabric having loops which may be joined or secured with exposed hooks on hook tape 34.

Figure 5:
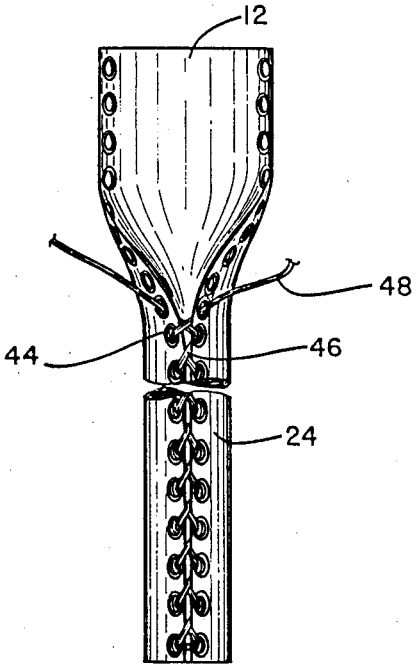
FIG. 5 is a front view similar to FIG. 3 showing a fourth sleeve embodiment.

Another embodiment of the invention is shown in FIG. 5 wherein the each edge of the generally rectangular sheet 12 is provided with eyelets 44. A lacing material 48 is disposed through the eyelets as shown permitting the handrail sleeve to be laced onto the metal tubing around which the sleeve material is placed. The lacing material 48 is crisscrossed as shown at 46 as it passes through each adjoining set of eyelets 44 so that the outer fabric layer 24 will be exposed to the user when the sheet 12 is attached to the handrail.

Figure 6:
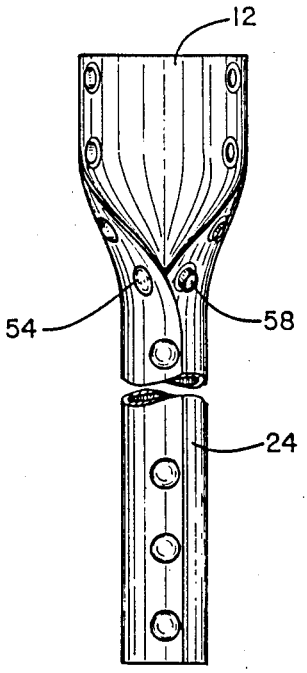
FIG. 6 is a front view similar to FIG. 3 showing a fifth sleeve embodiment.

Yet another embodiment of the invention is shown in FIG. 6. The outer edges of the sheet 12 are provided with cooperating snap-type buttons having a male button member 58 and a female button member 54 to permit the sleeve material to be mounted about the metal handrail and secured by snapping the button members together. When this is done, the outer fabric layer 24 will be exposed to the user.

It will be understood that the advantage of such a sleeve device as described hereinabove is that it is readily secured around and over a handrail which otherwise maybe too hot or slippery when grasped by a user. The sleeve is readily snugly formed along the entire length of the handrail to be covered, both straight as well as contiguous curved or arc-shaped portions. Moreover, since there is no handrail end exposed by which a sleeve could otherwise be threaded onto such a tubular handrail, the device of the present invention offers substantial advantage in being secured to a state of the art handrail. The sleeve may be easily removed for storage during seasons when the swimming pool is not used or is winterized thereby preventing deterioration of the material which would otherwise be exposed to sunlight, etc. Although the sleeve of the invention has been shown used on a swimming pool handrail, it will be useful on other similar curved handrails which are secured at both ends such that otherwise a sleeve cannot be threaded on. These as well as other advantages of the invention together with modifications of the components thereof within the purview of the invention will be evident to those skilled in the art.

I claim

1. A swimming pool or spa handrail assembly comprising:

(a) tubular handrail having a curved portion along the length thereof, (b) a removable sleeve secured entirely around(the exterior surface of said handrail along at least part of said curved portion; and (c) said sleeve comprising a laminated construction of an elongated, substantially rectangular sheet of synthetic elastomer disposed adjacent the exterior surface of the handrail and a sheet of fabric bonded substantially entirely to one surface of the elastomer sheet, said fabric sheet being the outer surface of the sleeve which is exposed to the user when the handrail is grasped and releasable securing means extending substantially along the entire length of the opposite edges of said elongated sheet for joining said opposite edges to secure said sleeve around and along said tubular handrail.

2. The assembly of claim 1 wherein said securing means comprises a zipper.

3. The assembly of claim 1 wherein said securing means comprises a hook element and a loop element, said hook element comprising a strip of material having a plurality of hooks extending therefrom and secured along one of said opposite edges of said elongated sheet, and said loop element comprises a plurality of loops on the exposed surface of said fabric sheet and secured along the other of said opposite edges of said elongated sheet.

4. The assembly of claim 1 wherein said securing means comprises a plurality of eyelets disposed along the opposite edges of the elongated sheet and a lacing means for joining the eyelets.

5. The assembly of claim 1 wherein said securing means comprises a plurality of snap buttons disposed along the opposite edges of the elongated sheet.

6. The assembly of claim 1 wherein said tubular handrail includes a substantially straight portion contiguous with said curved portion, and wherein said sleeve is secured around at least part of both of said straight and said curved portions.

7. In combination with a handrail installed adjacent to a swimming pool or spa, said handrail comprising a single length of tubular metal having no accessible open ends and having a curved portion extending over the edge of said pool and a straight portion contiguous with said curved portion, said portions for being gripped by the hands of a user when entering and leaving said pool, the improvement comprising a removable sleeve entirely around said curved portion and at least part of said straight portion, said sleeve comprising a laminated construction of an elongated substantially rectangular sheet of synthetic elastomer and a fabric sheet bonded substantially entirely on one surface of the elastomer sheet so that the fabric sheet is exposed for gripping by the user, and releasable securing means extending along substantially the entire length of the opposite edges of said elongated sheet for joining said opposite edges to secure said sleeve around and along said tubular handrail.

* * * * *